US011365599B2

(12) United States Patent
Glaesman

(10) Patent No.: US 11,365,599 B2
(45) Date of Patent: Jun. 21, 2022

(54) ENERGIZING SEALS WITH SWELLABLE MATERIALS

(71) Applicant: Halliburton Energy Services, Inc., Houston, TX (US)

(72) Inventor: Chad William Glaesman, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 329 days.

(21) Appl. No.: 16/613,048

(22) PCT Filed: Feb. 11, 2019

(86) PCT No.: PCT/US2019/017538
§ 371 (c)(1),
(2) Date: Nov. 12, 2019

(87) PCT Pub. No.: WO2020/167288
PCT Pub. Date: Aug. 20, 2020

(65) Prior Publication Data
US 2022/0003067 A1 Jan. 6, 2022

(51) Int. Cl.
*E21B 33/12* (2006.01)

(52) U.S. Cl.
CPC ..... *E21B 33/1208* (2013.01)

(58) Field of Classification Search
CPC ..... E21B 33/1208
See application file for complete search history.

(56) References Cited

U.S. PATENT DOCUMENTS

| | | | | |
|---|---|---|---|---|
| 3,385,367 | A * | 5/1968 | Kollsman | E21B 33/134 166/387 |
| 4,612,985 | A | 9/1986 | Rubbo et al. | |
| 9,624,752 | B2 * | 4/2017 | Resink | E21B 33/126 |
| 9,745,451 | B2 * | 8/2017 | Zhao | C08K 3/08 |
| 9,865,152 | B2 | 1/2018 | Gamstedt et al. | |
| 9,976,380 | B2 * | 5/2018 | Davis | E21B 33/1208 |
| 10,119,011 | B2 * | 11/2018 | Zhao | E21B 33/1208 |
| 10,364,636 | B2 * | 7/2019 | Davis | E21B 23/01 |
| 2005/0171248 | A1 | 8/2005 | Li et al. | |
| 2006/0175065 | A1 | 8/2006 | Ross | |
| 2007/0257405 | A1 * | 11/2007 | Freyer | E21B 33/1208 264/570 |
| 2009/0130938 | A1 * | 5/2009 | Xu | E21B 33/1208 442/327 |

(Continued)

FOREIGN PATENT DOCUMENTS

| | | | |
|---|---|---|---|
| GB | 2489723 | A | 10/2010 |
| WO | 2018147833 | A1 | 8/2018 |

OTHER PUBLICATIONS

International Search Report & Written Opinion in International Application No. PCT/US2019/017538, dated Nov. 11, 2019.

*Primary Examiner* — Steven A MacDonald
(74) *Attorney, Agent, or Firm* — McGuireWoods LLP

(57) ABSTRACT

Methods and apparatus for energizing seals. An example method includes providing a sealing apparatus. The sealing apparatus comprises a sealing element and a swellable material. The method further includes contacting the swellable material with a swell-inducing fluid, wherein the contacting swells the swellable material; applying pressure to the sealing element with the swollen swellable material; and forming a seal with the sealing element.

20 Claims, 5 Drawing Sheets

(56) References Cited

U.S. PATENT DOCUMENTS

| | | | | |
|---|---|---|---|---|
| 2010/0163252 | A1* | 7/2010 | Regnault De La Mothe | C09K 8/422 166/387 |
| 2012/0006530 | A1* | 1/2012 | Crabb | E21B 33/128 166/179 |
| 2012/0055667 | A1* | 3/2012 | Ingram | E21B 33/1216 166/119 |
| 2012/0292023 | A1* | 11/2012 | Hinkie | E21B 33/12 166/255.1 |
| 2013/0056227 | A1* | 3/2013 | Sponchia | E21B 33/1208 166/387 |
| 2014/0051612 | A1* | 2/2014 | Mazyar | E21B 33/1208 507/269 |
| 2014/0361497 | A1* | 12/2014 | Porta | E21B 33/1208 277/619 |
| 2015/0021044 | A1* | 1/2015 | Davis | E21B 33/1208 166/387 |
| 2015/0308214 | A1* | 10/2015 | Bilansky | E21B 33/1208 166/387 |
| 2016/0138359 | A1* | 5/2016 | Zhao | E21B 33/1208 277/316 |
| 2017/0191343 | A1* | 7/2017 | Solhaug | E21B 33/12 |
| 2019/0249509 | A1* | 8/2019 | Jakkula | E21B 33/1208 |
| 2019/0360297 | A1* | 11/2019 | Heiman | E21B 33/128 |

* cited by examiner

ENERGIZING SEALS WITH SWELLABLE MATERIALS

TECHNICAL FIELD

The present disclosure relates generally to wellbore operations, and more particularly, to energizing sealing elements with a swellable material during a wellbore operation.

BACKGROUND

Sealing elements may be used for forming seals in and around downhole tools. Sealing elements may restrict fluid and/or pressure communication at the seal interface. Forming seals may be an important part of wellbore operations at all stages of drilling, completion, and production.

Thermoplastic sealing elements are made from thermoplastic materials. Thermoplastic materials may be used for forming seals in conditions in which elastomeric sealing materials could be stressed beyond their mechanical, thermal, and chemical capacity. Thermoplastic sealing elements may be used in conjunction with an energizing mechanism to assist in forming and maintaining the seal. For example, thermoplastic sealing elements may be energized with springs. However, the spring constant of the spring does not change with environmental triggers and therefore cannot compensate for losses in the sealing efficiency of a thermoplastic sealing material. Similarly, metal sealing elements may be used to form seals. Metal sealing elements may also require energization to maintain sufficient pressure at the contact surface.

Sealing elements are an important part of wellbore operations, and it may be beneficial to form and maintain seals in a variety of applications. The present disclosure provides improved methods and apparatus for energizing sealing elements.

BRIEF DESCRIPTION OF THE DRAWINGS

Illustrative examples of the present disclosure are described in detail below with reference to the attached drawing figures, which are incorporated by reference herein, and wherein.

Figure 1:
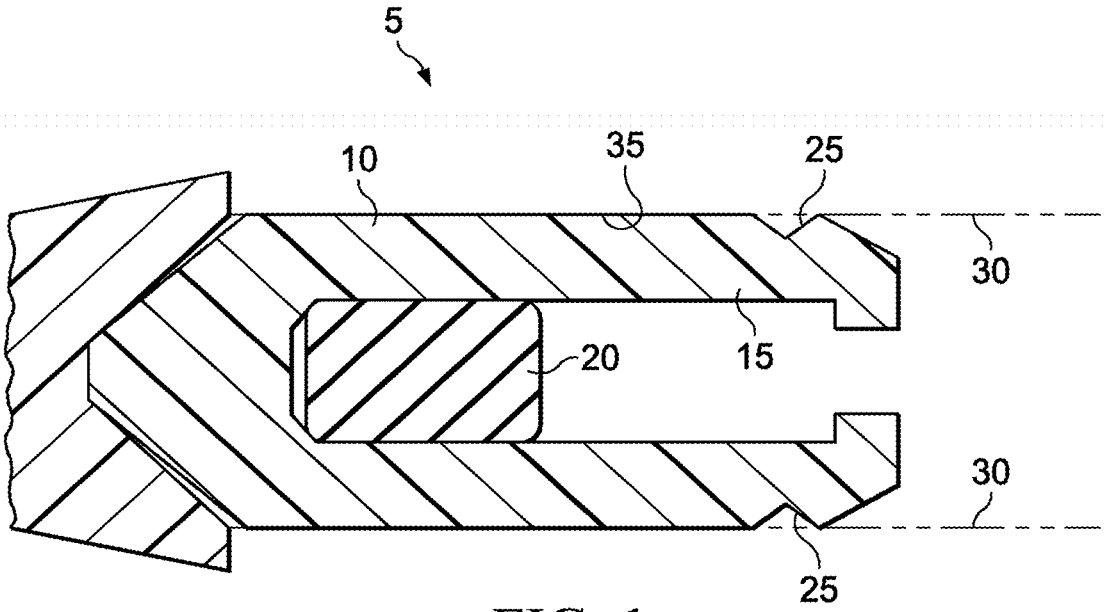
FIG. 1 is a cross-sectional illustration of a sealing apparatus which may be used to impede fluid flow in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to energizing sealing elements with a swellable material during a wellbore operation.

In the following detailed description of several illustrative examples, reference is made to the accompanying drawings that form a part hereof, and in which is shown by way of illustration examples that may be practiced. These examples are described in sufficient detail to enable those skilled in the art to practice them, and it is to be understood that other examples may be utilized and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The examples described herein relate to the use of swellable materials for energizing sealing elements. Advantageously, the sealing elements may be used at low pressures and at low temperatures. The sealing elements are energized by swellable materials that swell so long as they are in fluid contact, so sealing elements that may be less effective at low temperatures and low pressures, such as thermoplastic or metal sealing elements, may be used in a wider range of wellbore conditions. Further, the sealing elements may maintain the desired seal even after deformation occurs, for example, after a temperature swing from a high temperature to a low temperature. The swellable materials continue to swell so long as there is fluid contact and can therefore keep the sealing elements energized should plastic deformation or any degradation occur. Another advantage is that the swellable materials may be selected to provide this volumetric swelling energization in a variety of wellbore/treatment fluids. Moreover, the swellable materials may be selected to provide a desired swell rate and/or swell volume. Additionally, the swellable materials may be modified, for example, through the use of a diffusion barrier to limit contact of the swellable material with the swell-inducing fluid as desired. One other advantage is that the swellable materials may be used with a variety of thermoplastic and/or metal sealing elements. A still further advantage is that the swellable materials may be used in a variety of sealing element configurations. Moreover, in some examples, the swellable materials may swell to a sufficient volume so as to function as a secondary sealing element for some configurations of the sealing apparatus. One last advantage is that the swellable materials, in some examples, may provide sealing control of the thermoplastic sealing elements, such that the thermoplastic sealing elements seal only when energized by the swellable material, and the swellable material only swells when induced to do so through contact with the swell-inducing fluid.

The present disclosure details sealing apparatus and their use thereof. The sealing apparatus comprises a sealing element which may be any thermoplastic material and/or metal material used to form a seal. The sealing apparatus further comprises a swellable material which may be any swellable material sufficient for energizing the sealing element.

A thermoplastic sealing element comprises a thermoplastic material. The thermoplastic material generally includes any thermoplastic material sufficient for forming a seal. It is to be understood that the term "thermoplastic" encompasses any thermoplastic material, including, for example, thermoplastic elastomers. Examples of the thermoplastic materials include, but are not limited to, poly(methyl methacrylate), acrylonitrile butadiene styrene, polylactic acid, polybenzimidazole, polyoxymethylene, polyether ether ketone, polytetrafluoroethylene, polystyrene, polyethylene, polyphenylene oxide, polyphenylene sulfide, polypropylene, polystyrene, polyvinyl chloride, thermoplastic polyetherimides, thermoplastic elastomers, thermoplastic polyether sulfones, thermoplastic poly carbonates, thermoplastic polyolefinelastomers, thermoplastic vulcanizates, thermoplastic polyurethanes, thermoplastic copolyesters, thermoplastic polyamides, or any combination thereof. With the benefit of this disclosure, one of ordinary skill in the art will be readily able to select a thermoplastic material for a given sealing operation.

A metal sealing element comprises a metal material. As used herein, the use of the term "metal" encompasses all metal alloys including those that comprise non-metal materials (e.g., graphite, carbon, silicon, etc.) Examples of suitable metals for the metal sealing element include, but are not limited to, magnesium, calcium, aluminum, iron, nickel, copper, chromium, tin, zinc, lead, beryllium, gold, silver, lithium, sodium, potassium, rubidium, cesium, strontium, barium, gallium, indium, thallium, bismuth, scandium, titanium, vanadium, manganese, cobalt, yttrium, zirconium, niobium, molybdenum, ruthenium, rhodium, palladium, praseodymium, lanthanum, hafnium, tantalum, tungsten, terbium, rhenium, osmium, iridium, platinum, neodymium, gadolinium, erbium, or any combination thereof. Examples of suitable metal alloys for the metal sealing element include, but are not limited to, any alloys of magnesium, calcium, aluminum, iron, nickel, copper, chromium, tin, zinc, lead, beryllium, gold, silver, lithium, sodium, potassium, rubidium, cesium, strontium, barium, gallium, indium, thallium, bismuth, scandium, titanium, vanadium, manganese, cobalt, yttrium, zirconium, niobium, molybdenum, ruthenium, rhodium, palladium, praseodymium, lanthanum, hafnium, tantalum, tungsten, terbium, rhenium, osmium, iridium, platinum, neodymium, gadolinium, erbium, or any combination thereof.

The sealing elements may comprise any type of sealing element for any type of seal, examples of which include, but are not limited to, o-rings, v-seals, u-seals, u-cups, lip seals, chevron seals, washers, gaskets, rod seals, and more generally, any type of slip, packer element, wedge, sleeve, or other such wellbore component that may be translated or otherwise moved to seal against an adjacent surface. The sealing apparatus may further comprise any combination of the above sealing element species.

Generally, the swellable material comprises any swellable material that swells when in contact with a swell-inducing fluid, which may also be referred to as a swell agent. By "swell," "swelling," or "swellable" it is meant that the swellable material increases its volume. The swell-inducing fluid may be an aqueous fluid (e.g., freshwater, saltwater, brines, brackish water, etc.), an oleaginous fluid (e.g., hydrocarbon fluid, oil fluid, terpene fluid, diesel, gasoline, xylene, octane, hexane, etc.), or both an aqueous fluid and an oleaginous fluid. Thus, the swellable material may comprise an aqueous-swelling material, an oleaginous-swelling material, an aqueous- and oleaginous-swelling material, or a combination thereof.

For the purposes of the disclosure herein, the swellable material may be characterized as a volume expanding material. As will be appreciated by one of skill in the art, and with the help of this disclosure, the extent of swelling of the swellable material may depend upon a variety of factors, such as the downhole environmental conditions (e.g., temperature, pressure, composition of the swell-inducing fluid, pH, salinity, aromatic content, etc.). For purposes of the disclosure herein, upon swelling to at least some extent (e.g., partial swelling, substantial swelling, full swelling), the swellable material may be referred to as a "swelled material."

The degree of swelling of the swellable material may range from an increase in volume of about 10% to about 2000%. The volume increase may range from any lower limit to any upper limit and encompass any subset between the upper and lower limits. Some of the lower limits listed may be greater than some of the listed upper limits. One skilled in the art will recognize that the selected subset may require the selection of an upper limit in excess of the selected lower limit. Therefore, it is to be understood that every range of values is encompassed within the broader range of values. For example, the volume increase of the swellable material may range from about 10% to about 2000%, from about 50% to about 2000%, from about 100% to about 2000%, from about 500% to about 2000%, from about 1000% to about 2000%, or from about 1500% to about 2000%. As another example, the volume increase of the swellable material may range from about 10% to about 2000%, from about 10% to about 1500%, from about 10% to about 1000%, from about 10% to about 500%, from about 10% to about 100%, or from about 10% to about 50%. With the benefit of this disclosure, one of ordinary skill in the art will be readily able to select a swellable material having the desired degree of swelling for a given application.

Examples of aqueous-swelling materials include, but are not limited to compounds based on tetrafluorethylene/propylene copolymers, starch-polyacrylate acid graft copolymers, polyvinyl alcohol/cyclic acid anhydride graft copolymers, isobutylene/maleic anhydride copolymers, vinyl acetate/acrylate copolymers, polyethylene oxide polymers, graft-poly(ethylene oxide) of poly(acrylic acid) polymers, carboxymethyl cellulose polymers, crosslinked carboxylmethyl cellulose polymers, starch-polyacrylonitrile graft copolymers, polymethacrylate, polyacrylamide, acrylamide/acrylic acid copolymers, poly(2-hydroxyethyl methacrylate), poly(2-hydroxypropyl methacrylate), dicylopentadiene, non-soluble acrylic polymers, clay minerals, sodium bentonite (e.g., sodium bentonite having as a main ingredient montmorillonite), calcium bentonite, neutralized polyacrylic acid sodium salt, crosslinked isoprene-maleic acid salt, starch-polyacrylic acid salt, polyvinyl alcohol-acrylic acid salt, sodium acetate, sodium formate, sodium acrylate, sodium carbonate, potassium carbonate, lithium carbonate, calcium carbonate, magnesium carbonate, nitrile rubber, acrylonitrile/butadiene rubbers, hydrogenated nitrile rubbers, acrylic acid polymers, polyacrylate rubbers, fluorocarbon rubbers, perfluoro rubbers, the like, derivatives thereof, or any combinations thereof.

Examples of oleaginous-swelling materials include, but are not limited to compounds based on oil-swellable rubbers, natural rubbers, polyurethane rubber, acrylate/butadiene rubbers, butyl rubbers, brominated butyl rubbers, chlorinated butyl rubbers, chlorinated polyethylene rubbers, isoprene rubbers, chloroprene rubbers, neoprene rubbers, butadiene rubbers, styrene/butadiene copolymer rubbers, sulphonated polyethylenes, chlor-sulphonated polyethylene, ethylene/acrylate rubbers, epichlorohydrin/ethylene oxide copolymer rubbers, ethylene/propylene copolymer rubbers, ethylene/propylene/diene terpolymer rubbers, peroxide crosslinked ethylene/propylene copolymer rubbers, ethylene/propylene/diene terpolymer rubbers, ethylene/vinyl acetate copolymer rubbers, silicone rubbers, poly 2,2,1-bicyclo heptene (polynorbornene), alkylstyrene polymers, crosslinked substituted vinyl/acrylate copolymers, the like, derivatives thereof, or any combinations thereof.

Some optional examples may further comprise the addition of a barrier coating on the swellable materials. The barrier coating may control the rate of diffusion and/or the permeability of fluid flow across the barrier. The barrier coating may selectively control the rate of diffusion and/or fluid flow specific to a species of fluid. For example, in some embodiments the barrier coating may be hydrophilic. In other examples, the barrier coating may be hydrophobic. In some examples, the barrier coating may comprise multiple layers to further restrict the rate of diffusion across the barrier, and thereby restrict the rate of swelling of the swellable material. The number and thickness of the coating layers may be applied to selectively control the rate of diffusion across the barrier coating. In a specific example, the barrier coating material comprises a water-based coating material. In an alternative specific example, the barrier coating material comprises an organic solvent-based coating material. In a further alternative specific example, the barrier coating material comprises a one-component system. In a different alternative specific example, the barrier coating material comprises a multi-component system of different coating materials either as a composite material for a specific layer and/or as different layers comprising different barrier coating materials. Specific examples of the barrier coating materials may include, but are not limited to, plastics, polymeric materials, polyethylene, polypropylene, fluoro-elastomers, fluoro-polymers, fluoropolymer elastomers, polytetrafluoroethylene, a tetrafluoroethylene/propylene copolymer, polyamide-imide, polyimide, polyphenylene sulfide, or any combinations thereof.

FIG. 1 is a cross-sectional illustration of a sealing apparatus, generally 5, which may be used to impede fluid flow. The sealing apparatus 5 comprises a sealing element 10 having an expanding member 15. In some examples, the sealing element 10 is a thermoplastic, metal, or composite sealing element. In one specific example, the sealing element 10 is a thermoplastic sealing element. The sealing apparatus 5 further comprises swellable material 20. Swellable material 20 may be any swellable material as disclosed herein. As illustrated, the swellable material 20 has swollen in volume to a degree sufficient to energize the sealing element 10 by applying pressure from the volumetric expansion against the expanding member 15, thereby inducing the expanding member 15 to expand outward radially. As expanding member 15 expands radially, the contact surface 25 of the expanding member 15 may contact an adjacent surface 30 to form a seal at the seal interface 35 between the two surfaces. As such, the seal formed by the sealing apparatus 5 may prevent the flow of a fluid across the seal interface 35.

The expanding member 15 may stay energized so long as pressure is applied from the volumetric expansion of the swellable material 20. The swellable material 20 may stay swollen so long as it is in fluid contact with a swell-inducing fluid. As the swellable material 20 may continue to swell if it is able to absorb additional volumes of the swell-inducing fluid (e.g., if it has not reached its maximum swelling potential), the degree to which it may swell in the sealing apparatus 5 may ultimately only be limited by the volume of space in which the swellable material 20 is allowed to swell. As such, should the volume of space around the swellable material 20 increase over time, for example, due to degradation or deformation of the contact surface 25 of the expanding member 15, the swellable material 20 may continue to expand and apply continuous pressure to counter this degradation or deformation by further energizing the sealing element 10. This additional applied pressure may mitigate a decrease in seal integrity due to the degradation and/or deformation of the sealing element 10. Moreover, this may also mitigate the effects of defects in the contact surfaces of the sealing element 10 and the corresponding adjacent surface 30. For examples, gashes, cuts, divots, gaps, and the like in the surfaces at the seal interface 35 may have a reduced impact (or no impact) on seal integrity from the applied additional pressure maintained by the volumetric expansion of the swellable material 20.

It should be clearly understood that the example sealing apparatus 5 illustrated by FIG. 1 is merely one general application of the principles of this disclosure in practice, and a wide variety of other examples are possible. Therefore, the scope of this disclosure is not limited in any manner to the details of FIG. 1 as described herein.

Figure 2A:
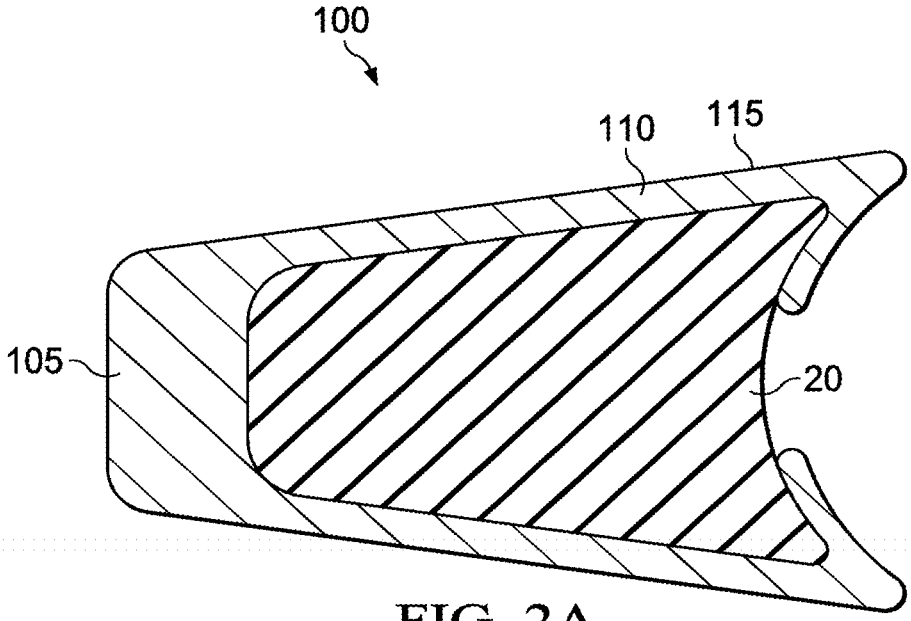
FIG. 2A is a cross-sectional illustration of another sealing apparatus which may be used to impede fluid flow in accordance with one or more examples described herein.
Figure 2B:
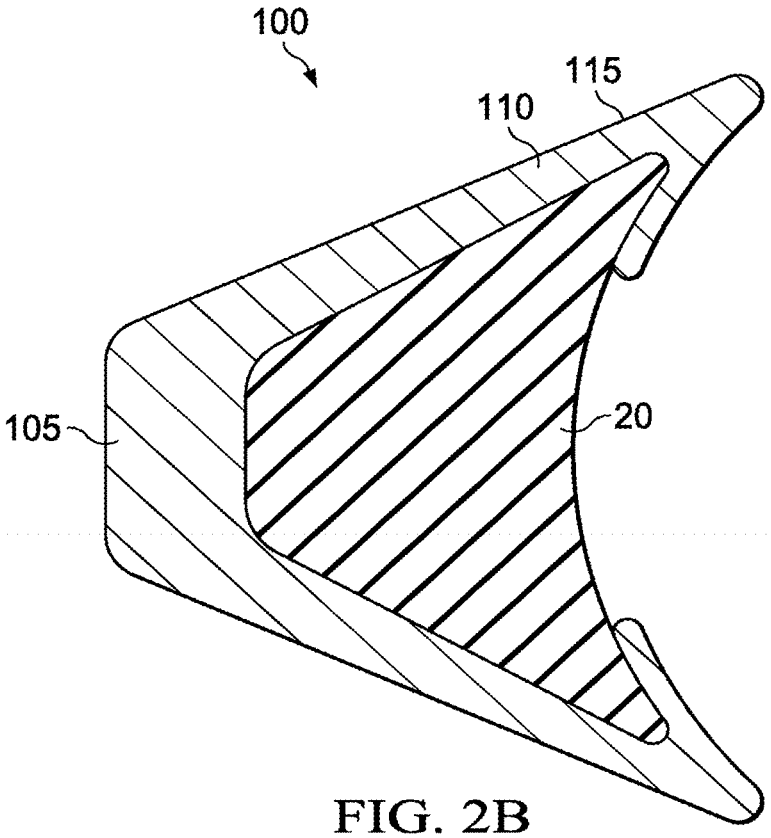
FIG. 2B is a cross-sectional illustration of the sealing apparatus of FIG. 2A in the expanded state in accordance with one or more examples described herein.

FIGS. 2A-2B are cross-sectional illustrations of another example of a sealing apparatus, generally 100, which may be used to impede fluid flow. FIG. 2A illustrates the sealing apparatus 100 in its unexpanded state. FIG. 2B illustrates the sealing apparatus 100 in its expanded state. The sealing apparatus 100 comprises a metal sealing element 105 having an expanding member 110. The metal sealing element 105 functions as a thin metal "jacket" for the swellable material 20 with the thinnest portion of the metal sealing element 105 being the expanding member 110. The expanding member 110 should be of a metal material and also a width that renders the expanding member 110 sufficiently pliable such that the swellable material 20 is able to energize and pressure the expanding member 110 to expand radially. The swellable material 20 may be the same or a different swellable material 20. As illustrated, the swellable material 20 has swollen in volume to a degree sufficient to energize the metal sealing element 105 by applying pressure from this volumetric expansion against the expanding member 110 to induce expanding member 110 to expand radially outward as illustrated in FIG. 2B. As the expanding member 110 expands radially, the contact surface 115 of the expanding member 110 may contact an adjacent surface (not illustrated) to form a seal at the seal interface of the contact surface 115 and the adjacent surface. As such, the sealing apparatus 100 may prevent the flow of a fluid across said seal interface.

As discussed above in FIG. 1, the expanding member 110 may stay energized so long as pressure is applied from the volumetric expansion of the swellable material 20. The swellable material 20 may stay swollen so long as it is in fluid contact with a swell-inducing fluid. In some examples, swelling may not be reversible or may be only partially reversible. In these specific examples, the swellable material 20 may not decrease in volume or may decrease in volume, but still retain some degree of the volumetric expansion. As such, the swellable material 20 may continue to expand and apply continuous pressure to mitigate a loss in seal integrity by further energizing the metal sealing element 105, thereby preventing a decrease in seal integrity. In some examples, swellable material 20 may only be required to engage the sealing element, for example, metal sealing element 20. In some examples, after a sealing element provides the seal, the seal may continue to pressure energize.

It should be clearly understood that the example sealing apparatus 100 illustrated by FIGS. 2A and 2B is merely one general application of the principles of this disclosure in practice, and a wide variety of other examples are possible. Therefore, the scope of this disclosure is not limited in any manner to the details of FIGS. 2A and 2B as described herein.

Figure 3:
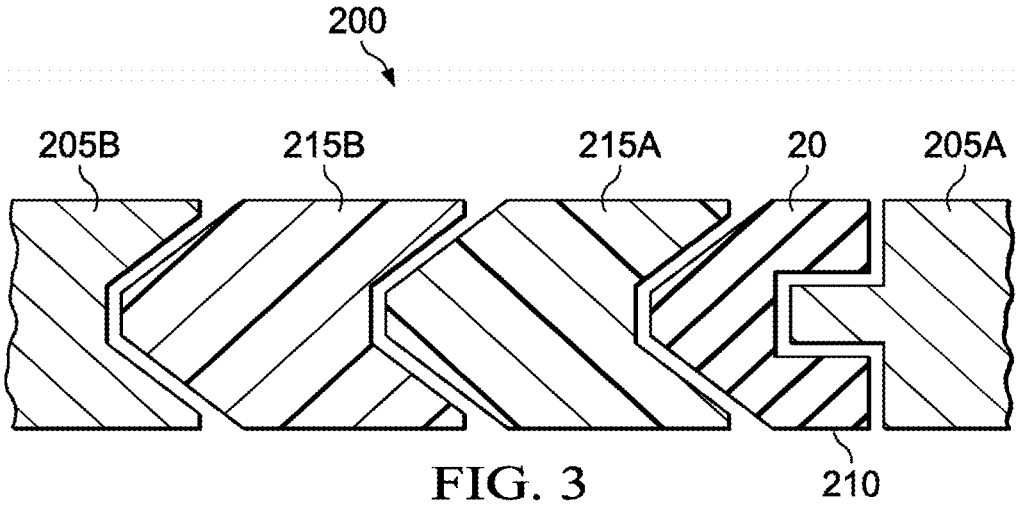
FIG. 3 is a cross-sectional illustration of a seal stack which may be used to impede fluid flow in accordance with one or more examples described herein.

FIG. 3 is a cross-sectional illustration of a sealing apparatus, generally 200, which may be used to impede fluid flow. The sealing apparatus 200 may be generally described as a seal stack as it contains a plurality of sealing elements that seal against each other in a series. The sealing apparatus 200 comprises thermoplastic and metal sealing elements, respectively 215 and 205, as well as a swellable sealing element 210. The sealing elements 205, 210, and 215, may comprise any sealing element, for example, o-rings, chevron seals, v-seals, etc. The sealing apparatus 200 further comprises a swellable material 20. The swellable material 20 may be the same or a different swellable material 20. The sealing apparatus 200 further comprises metal sealing elements 205. The metal sealing elements 205 may comprise the same or different metal materials. As an example, the metal sealing elements may comprise titanium. The metal sealing elements 205 may be positioned at the terminal ends of the sealing apparatus 200. Disposed adjacent to the metal sealing element 205A is a swellable sealing element 210. The swellable sealing element 210 comprises the swellable material 20. Disposed adjacent to the swellable sealing element 210 is a thermoplastic sealing element 215, specifically 215A. Disposed between the thermoplastic sealing element 215A and the metal sealing element 205A, is a thermoplastic sealing element 215B. The thermoplastic sealing elements may be the same or a different material. For example, the thermoplastic sealing element 215A may be a polytetrafluoroethylene, and the thermoplastic sealing element 215B may be a polyether ether ketone.

With continued reference to FIG. 3, the swellable sealing element 210 may swell when contacted with a swell-inducing fluid. As the swellable material 20 swells, the swellable sealing element 210 provides pressure at the surfaces of the metal sealing element 205A and the thermoplastic sealing element 215A. In turn, the thermoplastic sealing element 215A may then be pressured against the thermoplastic sealing element 215B. The thermoplastic sealing element 215B may then be pressured against the metal sealing element 205B. As such, the volumetric expansion of the swellable material 20 may continuously apply sufficient pressure to form a seal between the contact surfaces of all sealing elements in the sealing apparatus 200. Moreover, the swellable material 20 functions as a sealing element in this specific example, in addition to energizing the other sealing elements. Additionally, this example illustrates that the swellable material 20 may be configured to energize seals between different sealing elements comprising different materials. As discussed above, the swellable material 20 may continue to apply pressure so long as fluid contact is maintained. Should any one of the sealing elements degrade and/or deform, the additional pressure applied by the swellable material 20 may be sufficient to maintain the seal integrity of the sealing apparatus 200.

It should be clearly understood that the example sealing apparatus 200 illustrated by FIG. 3 is merely a general application of the principles of this disclosure in practice, and a wide variety of other examples are possible. Therefore, the scope of this disclosure is not limited in any manner to the details of FIG. 3 as described herein.

Figure 4:
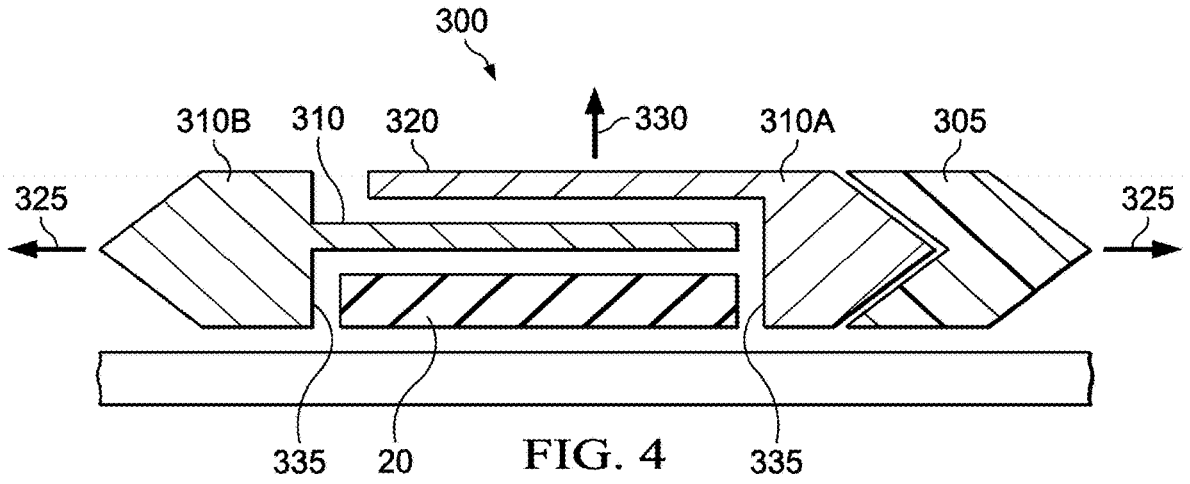
FIG. 4 is a cross-sectional illustration of a double-male adapter which may be used to impede fluid flow in accordance with one or more examples described herein.

FIG. 4 is a cross-sectional illustration of a sealing apparatus, generally 300, which may be used to impede fluid flow. The sealing apparatus 300 may be generally described as a as a double male adapter having a first and second male adapters 310A and 310B, respectively. In alternative examples, the sealing apparatus 300 may be a single male adapter. The sealing apparatus 300 comprises a sealing element 305, positioned adjacent to a first male adapter 310A. The sealing element 305 may comprise any sealing element material and any sealing element type disclosed herein. In alternative examples, an additional sealing element may be positioned adjacent to the second male adapter 310B. The sealing apparatus 300 further comprises swellable material 20. The swellable material 20 may be the same or a different swellable material 20. The swellable material 20 is disposed between the first male adapter 310A and the second male adapter 310B. The first male adapter 310A and the second male adapter 310B comprise elongated arms 320 which may be a flange, a collar, or any general extending member. The elongated arms 320 may be coupled together and/or configured in a way (e.g., a slotted connection, railed connection, etc.) such that the first and second male adapters 310A and 310B expand in the lengthwise direction indicated by arrow 325 and not in the direction indicated by arrow 330. Thus, the elongated arms 320 restrict the expansion of the swellable material 20 in the direction indicated by arrows 330.

With continued reference to FIG. 4, swellable material 20 may swell when contacted with a swell-inducing fluid. As discussed above, the swelling may be restricted by the elongated arms 320 such that the swelling occurs in the lengthwise direction indicated by arrow 325. This directional expansion of the swellable material 20 applies pressure to the contact surfaces 335 of the first and second male adapters 310A and 310B. Pressure applied to the contact surface 335 of the first male adapter 310A translates the first male adapter 310A in the lengthwise direction to apply pressure to the sealing element 305 which may be pressured against an adjacent surface (not pictured), thereby energizing a subsequently formed seal. This example illustrates an example of configuring the swellable material 20 to translate a non-sealing component in a desired direction to form a seal using a sealing element 305 coupled to the non-sealing component. In alternative examples, the first and second male adapters 310A and 310B may comprise the sealing elements 305 themselves and may be energized directly from the pressure applied by the swellable material 20. The swellable material 20 may continue to apply pressure so long as fluid contact is maintained. Should any one of the sealing elements 305 degrade and/or deform, the additional pressure applied by the swellable material 20 may be sufficient to maintain seal integrity of the sealing apparatus 300.

It should be clearly understood that the example sealing apparatus 300 illustrated by FIG. 4 is merely a general application of the principles of this disclosure in practice, and a wide variety of other examples are possible. Therefore, the scope of this disclosure is not limited in any manner to the details of FIG. 4 as described herein.

Figure 5A:
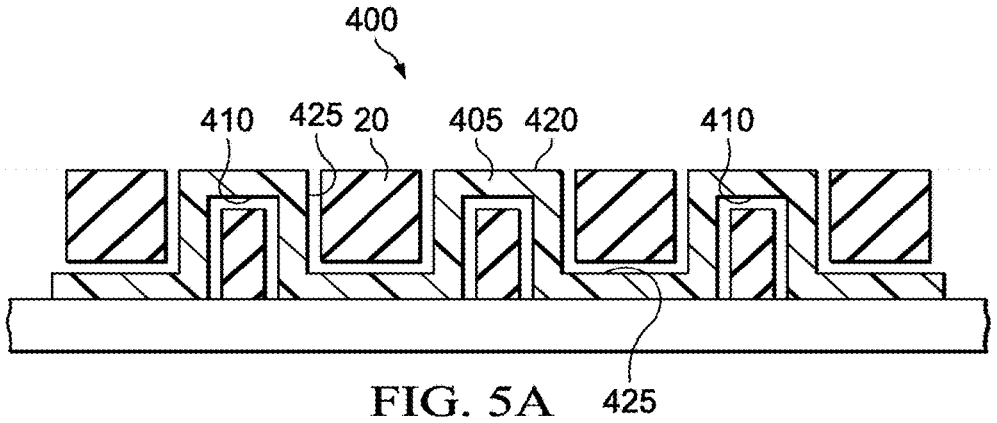
FIG. 5A is a cross-sectional illustration of a sealing apparatus comprising a sealing element having an oscillating pattern which may be used to impede fluid flow in accordance with one or more examples described herein.
Figure 5B:
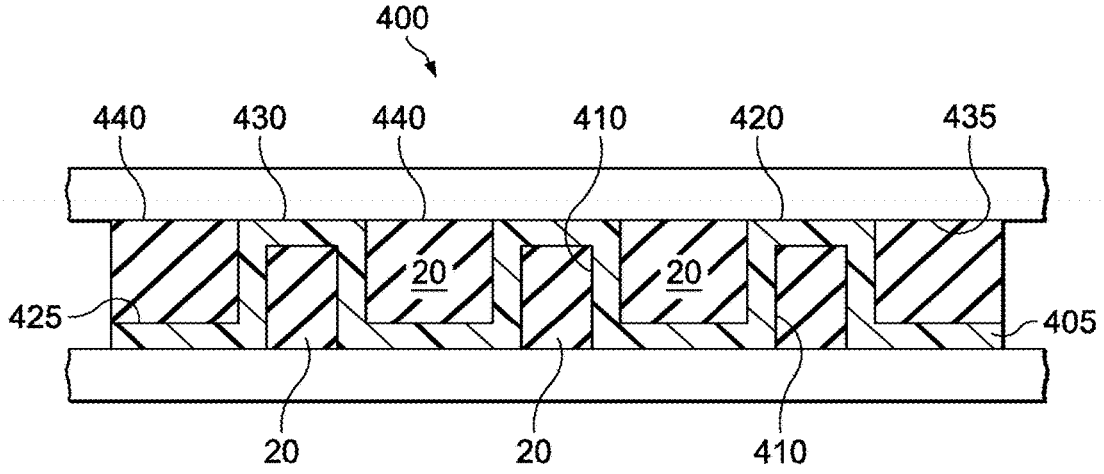
FIG. 5B is a cross-sectional illustration of the sealing apparatus of FIG. 5A in the sealed state in accordance with one or more examples described herein.

FIGS. 5A-5B are cross-sectional illustrations of another example of a sealing apparatus, generally 400, which may be used to impede fluid flow. FIG. 5A illustrates the sealing apparatus 400 in its unexpanded state. FIG. 5B illustrates the sealing apparatus 400 in its expanded state. Sealing apparatus 400 comprises a sealing element 405 having a general shape of a square waveform. Alternative examples may comprise other shapes such as sine waveforms, triangle waveforms, sawtooth waveforms, or any other oscillating pattern. Sealing element 405 may comprise any sealing element material disclosed herein (for example, a thermoplastic or metal). The sealing element 405 comprises slots 410 in which a swellable material 20 may be disposed. The swellable material 20 may be the same or different swellable material 20 as described in FIG. 1. On the exterior surface 420 of the sealing element 405, grooves 425 are disposed periodically. Within these grooves 425, additional swellable material 20 may be disposed which may contact the exterior surface 420 of the sealing element 405.

With reference to FIG. 5B, when a swell-inducing fluid contacts the swellable material 20, the swellable material 20 within slots 410 may apply pressure to the sealing element 405 to energize seals formed at the interface 430 of sealing element 405 and an adjacent surface 435. The swellable material 20 located within the grooves 425 may also swell and form seals at the interface 440 of this swellable material 20 and the adjacent surface 435. As such, the sealing apparatus 400 may prevent the flow of a fluid across said seal interfaces 430 and 440. The seals may stay energized so long as pressure is applied from the volumetric expansion of the swellable material 20. The swellable material 20 may stay swollen so long as it is in fluid contact with a swell-inducing fluid. As such, the swellable material 20 may continue to expand and apply continuous pressure to mitigate a loss in seal integrity by further energizing the sealing element 405.

It should be clearly understood that the example sealing apparatus 400 illustrated by FIGS. 5A and 5B is merely one general application of the principles of this disclosure in practice, and a wide variety of other examples are possible. Therefore, the scope of this disclosure is not limited in any manner to the details of FIGS. 5A and 5B as described herein.

Figure 6:
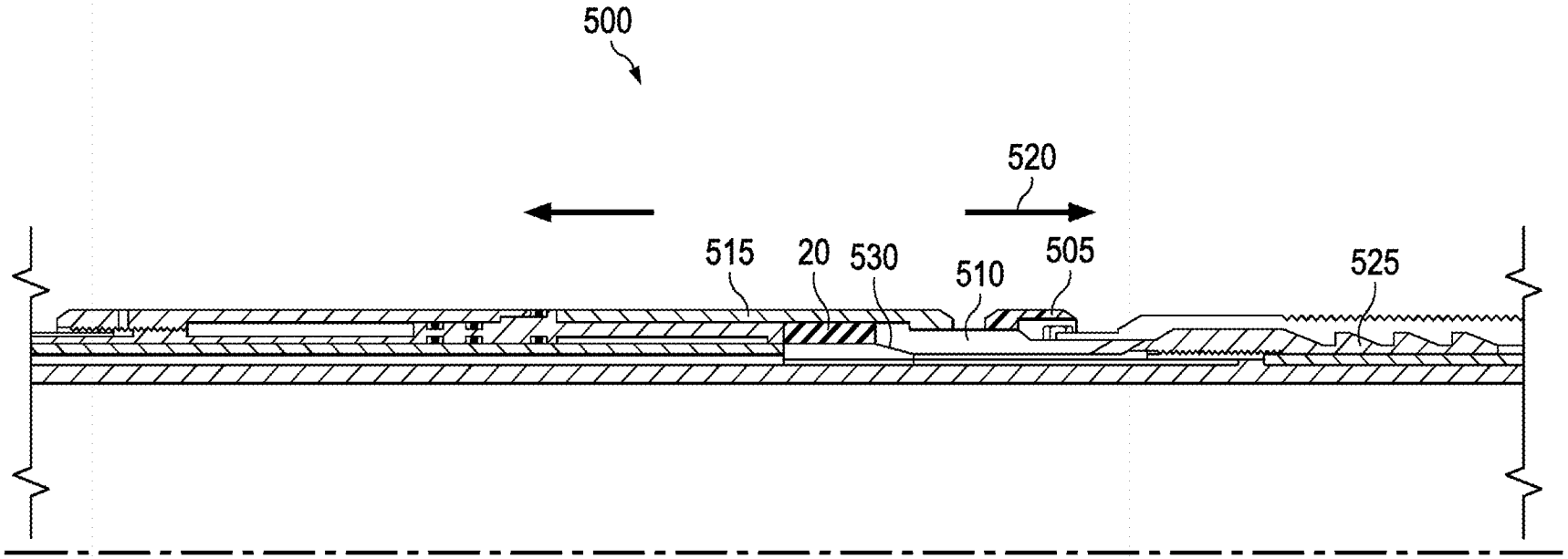
FIG. 6 is a cross-sectional illustration of a packer which may be used to impede fluid flow in accordance with one or more examples described herein.

FIG. 6 is a cross-sectional illustration of a sealing apparatus, generally 500, which may be used to impede fluid flow. The sealing apparatus 500 may be generally described as a packer and may be used in zonal/annular isolation. The sealing apparatus 500 comprises a sealing element 505 (e.g., a packer element) which may be set to form a seal against an adjacent surface. The sealing element 505 may comprise any sealing element material described herein. The sealing apparatus 500 further comprises swellable material 20. The swellable material 20 may be the same or different swellable material 20. The sealing apparatus 500 further comprises sleeve 510 and retaining cover 515. Sleeve 510 may be actuated by the swollen swellable material 20 and translate in the direction indicated by arrow 520. Translation of sleeve 510 may induce retaining cover 515, which is coupled thereto, to also translate in the direction indicated by arrow 520 where the retaining cover 515 may actuate sealing element 505. Sleeve 510 may be coupled to retaining cover 515 at shoulder 530 such that the translation of sleeve 510 also induces translation of the coupled retaining cover 515 which may be brought to a position where it abuts sealing element 505 and applies sufficient contact pressure to the sealing element 505 to induce radial expansion of the sealing element 505. The contact pressure against the sealing element 505 may compress the sealing element 505 in the axial direction of the sealing apparatus 500. This axial compression may induce the radial expansion of the sealing element 505. The radial expansion of the sealing element 505 may allow the sealing element 505 to press against an adjacent surface such as a casing or wellbore wall and form a seal thereagainst. Ridges 525 may prevent the translation of the sleeve 510 in the direction opposite of that indicated by arrow 520. The ridges 525 thus prevent the counterforce applied by the sealing element 505 against the retaining cover 515 from reversing the axial translation of the sleeve 510.

Additionally, the volumetric expansion of the swellable material 20 continuously applies pressure to the sleeve 510 so long as the swellable material 20 maintains contact with a swell-inducing fluid. As such, swellable material 20 is able to continuously energize the seal formed from the radial expansion of the sealing element 505 by continuing to apply and maintain pressure against the sleeve 510. Should the sealing element 505 degrade and/or deform, the additional pressure applied by the swellable material 20 may be sufficient to maintain seal integrity of the sealing apparatus 500. Although sealing apparatus 500 illustrates a singular sealing element 505, it is to be understood that a plurality of sealing elements 505 may be used without departing from the teachings of this disclosure.

It should be clearly understood that the example sealing apparatus 500 illustrated by FIG. 6 is merely a general application of the principles of this disclosure in practice, and a wide variety of other examples are possible. Therefore, the scope of this disclosure is not limited in any manner to the details of FIG. 6 as described herein.

Figure 7:
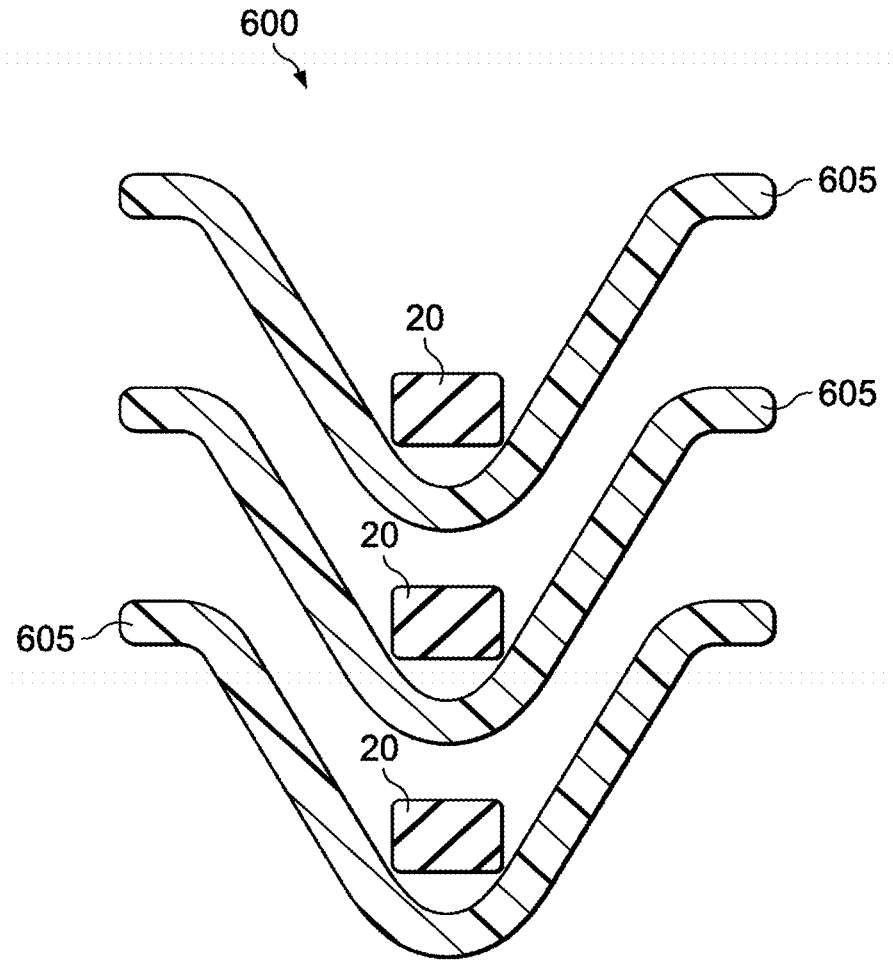
FIG. 7 is a cross-sectional illustration of a v-stack which may be used to impede fluid flow in accordance with one or more examples described herein.

FIG. 7 is a cross-sectional illustration of a sealing apparatus, generally 600, which may be used to impede fluid flow. The sealing apparatus 600 may generally be described as a seal stack of v-seals. The sealing apparatus 600 comprises a series of sealing elements 605, which are illustrated as v-seals or v-packing elements. The sealing elements 605 may comprise any species of sealing element material as disclosed herein. Disposed between the adjacent sealing elements 605 is a swellable material 20. The swellable material 20 may be any swellable material as disclosed herein. When contacted with a swell-inducing fluid, the swellable material 20 may swell and apply pressure to an adjacent sealing element 605. Pressure applied to a sealing element 605 may induce the sealing element 605 to engage an adjacent sealing element 605 in the series to form a seal thereagainst. This process may be repeated for other sealing elements 605 in the series.

The seal formed between the sealing elements 605 may stay energized so long as pressure is applied from the volumetric expansion of the swellable material 20. The swellable material 20 may stay swollen so long as it is in fluid contact with the swell-inducing fluid. Should one or more sealing elements 605 degrade and/or deform, the additional pressure applied by the swellable material 20 may be sufficient to maintain seal integrity of the sealing apparatus 600. Although sealing apparatus 600 illustrates three sealing elements 605, it is to be understood that more or less than three sealing elements 605 may be used without departing from the scope of this disclosure.

It should be clearly understood that the example sealing apparatus 600 illustrated by FIG. 7 is merely one general application of the principles of this disclosure in practice, and a wide variety of other examples are possible. Therefore, the scope of this disclosure is not limited in any manner to the details of FIG. 7 as described herein.

The disclosed seal energizing systems may be used in any tool comprising a sealing element. The tools may be any oilfield tool including both downhole tools and surface tools. Examples of the potential tools include, but are not limited to, packers, frac plugs, safety valves, fluid loss valves, sliding sleeves, flow control plugs, inflow control devices, the like, and any combination thereof.

It is also to be recognized that the disclosed sealing apparatus may also directly or indirectly affect the various downhole equipment and tools that may contact the sealing apparatus disclosed herein. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the methods and systems generally described above and depicted in FIGS. 1-7.

Provided are methods for energizing a seal. An example method comprises providing a sealing apparatus. The sealing apparatus comprises a sealing element and a swellable material. The method further comprises contacting the swellable material with a swell-inducing fluid, wherein the contacting swells the swellable material; applying pressure to the sealing element with the swollen swellable material; and forming a seal with the sealing element.

Additionally or alternatively, the method may include one or more of the following features individually or in combination. The sealing element may comprise a sealing material selected from the group consisting of a thermoplastic material, a metal material, or a composite thereof. The swell-inducing fluid may be an aqueous fluid. The swell-inducing fluid may be an oleaginous fluid. The sealing element may be a sealing element selected from the group consisting of an o-ring, v-seal, u-seal, u-cup, lip seal, chevron seal, washer, gasket, rod seal, slip, wedge, sleeve, and any combination thereof. The sealing apparatus may be a packer, a seal stack, or a double-male adapter. The sealing element may comprise an oscillating pattern. The swellable material may comprise a barrier coating.

Provided are sealing apparatus in accordance with the disclosure. An example sealing apparatus comprises a sealing element and a swellable material. The swellable material is configured to apply pressure to the sealing element after the swellable material has swollen; wherein the sealing element is configured to seal after pressure has been applied by the swollen material.

Additionally or alternatively, the sealing apparatus may include one or more of the following features individually or in combination. The sealing element may comprise a sealing material selected from the group consisting of a thermoplastic material, a metal material, or a composite thereof. The swellable material may be configured to swell after contact with an aqueous fluid. The swellable material may be configured to swell after contact with an oleaginous fluid. The sealing element maybe a sealing element selected from the group consisting of an o-ring, v-seal, u-seal, u-cup, lip seal, chevron seal, washer, gasket, rod seal, slip, wedge, sleeve, and any combination thereof. The sealing apparatus may be a packer, a seal stack, or a double-male adapter. The sealing element may comprise an oscillating pattern. The swellable material may comprise a barrier coating.

Provided are systems for energizing a seal in accordance with the disclosure. An example system comprises a sealing apparatus. The sealing apparatus comprises a sealing element and a swellable material. The swellable material is configured to apply pressure to the sealing element after the swellable material has swollen. The sealing element is configured to seal after pressure has been applied by the swollen material. The system further comprises a tubular adjacent to the sealing apparatus.

Additionally or alternatively, the system may include one or more of the following features individually or in combination. Additionally or alternatively, the system may include one or more of the following features individually or in combination. The sealing element may comprise a sealing material selected from the group consisting of a thermoplastic material, a metal material, or a composite thereof. The swellable material may be configured to swell after contact with an aqueous fluid. The swellable material may be configured to swell after contact with an oleaginous fluid. The sealing element maybe a sealing element selected from the group consisting of an o-ring, v-seal, u-seal, u-cup, lip seal, chevron seal, washer, gasket, rod seal, slip, wedge, sleeve, and any combination thereof. The sealing apparatus may be a packer, a seal stack, or a double-male adapter. The sealing element may comprise an oscillating pattern. The swellable material may comprise a barrier coating.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A method for energizing a seal, the method comprising:
providing a sealing apparatus comprising:
a sealing element comprising an oscillating pattern with alternating grooves, and
a swellable material disposed in the alternating grooves;
contacting the swellable material with a swell-inducing fluid, wherein the contacting swells the swellable material;
applying pressure to the sealing element with the swollen swellable material; and
forming a seal against an adjacent surface with both the sealing element and the swollen swellable material.

2. The method of claim 1, wherein the sealing element comprises a sealing material selected from the group consisting of a thermoplastic material, a metal material, or a composite thereof.

3. The method of claim 1, wherein the swell-inducing fluid is an aqueous fluid.

4. The method of claim 1, wherein the swell-inducing fluid is an oleaginous fluid.

5. The method of claim 1, wherein the sealing element is a sealing element selected from the group consisting of an o-ring, v-seal, u-seal, u-cup, lip seal, chevron seal, washer, gasket, rod seal, slip, wedge, sleeve, and any combination thereof.

6. The method of claim 1, wherein the sealing apparatus is a packer, a seal stack, or a double-male adapter.

7. The method of claim 1, wherein the swellable material comprises a barrier coating.

8. A sealing apparatus comprising:
a sealing element comprising an oscillating pattern with alternating grooves, and
a swellable material disposed in the alternating grooves;
wherein the swellable material is configured to apply pressure to the sealing element after the swellable material has swollen; wherein the sealing element is configured to seal after pressure has been applied by the swollen swellable material; wherein the swollen swellable material is configured to seal after it has swollen.

9. The sealing apparatus of claim 8, wherein the sealing element comprises a sealing material selected from the group consisting of a thermoplastic material, a metal material, or a composite thereof.

10. The sealing apparatus of claim 8, wherein the swellable material is configured to swell after contact with an aqueous fluid.

11. The sealing apparatus of claim 8, wherein the swellable material is configured to swell after contact with an oleaginous fluid.

12. The sealing apparatus of claim 8, wherein the sealing element is a sealing element selected from the group consisting of an o-ring, v-seal, u-seal, u-cup, lip seal, chevron seal, washer, gasket, rod seal, slip, wedge, sleeve, and any combination thereof.

13. The sealing apparatus of claim 8, wherein the sealing apparatus is a packer, a seal stack, or a double-male adapter.

14. The sealing apparatus of claim 8, wherein the swellable material comprises a barrier coating.

15. A system for energizing a seal, the system comprising:
a sealing apparatus comprising:
a sealing element comprising an oscillating pattern with alternating grooves, and
a swellable material disposed in the alternating grooves;
wherein the swellable material is configured to apply pressure to the sealing element after the swellable material has swollen; wherein the sealing element is configured to seal after pressure has been applied by the swollen swellable material; wherein the swollen swellable material is configured to seal after it has swollen;
a tubular adjacent to the sealing apparatus.

16. The system of claim 15, wherein the sealing element comprises a sealing material selected from the group consisting of a thermoplastic material, a metal material, or a composite thereof.

17. The system of claim 15, wherein the sealing element is a sealing element selected from the group consisting of an o-ring, v-seal, u-seal, u-cup, lip seal, chevron seal, washer, gasket, rod seal, slip, wedge, sleeve, and any combination thereof.

18. The system of claim 15, wherein the sealing apparatus is a packer, a seal stack, or a double-male adapter.

19. The system of claim 15, wherein the swellable material is configured to swell after contact with an aqueous fluid.

20. The system of claim 15, wherein the swellable material is configured to swell after contact with an oleaginous fluid.

* * * * *